US005601791A

United States Patent [19]

Plaks et al.

[11] Patent Number: 5,601,791

[45] Date of Patent: Feb. 11, 1997

[54] ELECTROSTATIC PRECIPITATOR FOR COLLECTION OF MULTIPLE POLLUTANTS

[75] Inventors: Norman Plaks, Raleigh; Charles B. Sedman, Hillsborough; Leslie E. Sparks, Durham, all of N.C.

[73] Assignee: The United States of America as represented by the Administrator of the U.S. Environmental Protection Agency, Washington, D.C.

[21] Appl. No.: 350,295

[22] Filed: Dec. 6, 1994

[51] Int. Cl.[6] ..... B03C 3/00; B03C 3/04

[52] U.S. Cl. ..... 422/169; 422/172; 95/59; 95/65; 95/75; 96/53; 96/77; 96/79; 96/86

[58] Field of Search ..... 422/169–172, 422/173, 177; 55/334; 95/65, 59, 75, 64, 68; 96/53, 55, 52, 44, 47, 77, 96, 86, 79

[56] References Cited

U.S. PATENT DOCUMENTS

| | | | |
|---|---|---|---|
| 3,444,668 | 5/1969 | Masuda | 96/47 |
| 4,231,766 | 11/1980 | Spurgin | 96/79 |
| 4,257,258 | 3/1981 | Bovenlander | 96/86 |
| 4,301,128 | 11/1981 | Hastrup | 96/52 |
| 4,885,139 | 12/1989 | Sparks et al. | 422/169 |
| 5,047,221 | 9/1991 | Yozewicz et al. | 423/243.1 |
| 5,059,219 | 10/1991 | Plaks et al. | 96/77 |
| 5,217,511 | 6/1993 | Plaks et al. | 96/55 |

*Primary Examiner*—Robert J. Warden
*Assistant Examiner*—Hien Tran
*Attorney, Agent, or Firm*—Thomas W. Gorman; George A. Loud

[57] ABSTRACT

A novel electrostatic precipitator includes an electrostatic collector section with discharge electrodes positioned between pairs of grounded collector electrodes, a gas entry port located upstream of said electrostatic collector section, and a transition section between the gas entry port and said electrostatic collector section into which an aqueous acid gas neutralizing agent is sprayed into a gas stream. An additional collector section may be interposed between the gas entry port and the point where the acid gas neutralizing agent is injected into the gas stream. The collector section may comprise alternating charging and short collection sections in which the grounded electrodes of adjoining charger and collector sections are connected. A liquid spray removes particulates collected on the grounded electrodes of the collector sections.

18 Claims, 9 Drawing Sheets

ELECTROSTATIC PRECIPITATOR FOR COLLECTION OF MULTIPLE POLLUTANTS

FIELD OF THE INVENTION

This invention relates generally to electrostatic precipitators (hereinafter "ESPs") for air pollution control, and more specifically, to the removal of particulate matter, sulfur oxides and other acid gases, and trace metals from a gas stream.

BACKGROUND OF THE INVENTION

Electric power generating plants, industrial boilers, and other industrial processes generate particulates, acid gases and toxic materials that are frequently harmful to the environment. Particulate matter can remain suspended in the air for an extended period during which time the particulates present a potential health hazard. The particulates also tend to settle on surfaces such as buildings, machinery, or curtains, where they can cause unsightly blemishes or other problems. In addition, trace metals that often are harmful to humans and other species tend to concentrate on the fine particulates in a gas stream. Thus, it is important to remove particulates from an exhaust gas stream.

Acid gases, such as $SO_2$ and $SO_x$ have been found to contribute to damaging acid rain. Technologies for control of acid gases such as spray dryers and scrubbers are well known in the art. However, such control systems are expensive and their installation requires significant amounts of space. Space constraints are especially troublesome in existing installations that must be retrofitted for acid gas removal.

Control of particulate emissions from industrial sources is accomplished largely by fabric filters and ESPs, with the greatest amount of particulate reduction being accomplished by ESPs. Current ESP technology operates upon the principle that particles are charged and then collected on the oppositely charged collector plates of an ESP. To accomplish this simultaneous charging and collection, a multiplicity of corona discharge electrodes are placed along the center line of a gas flow lane between a pair of grounded collector plates. A sufficiently high voltage is placed upon the corona discharge electrodes to cause the generation of a visible corona. The copious supply of ions formed by this corona charges particles in the gas, which are then attracted to the collecting plates by the electric field caused by the high voltage placed on the corona discharge electrodes relative to the grounded collector plates. Conventional ESP's are well documented by an abundant number of textbooks and other literature. Examples in the literature are: H, White, *Industrial Electrostatic Precipitation,* Addison-Wesley, Reading, Mass., 1963; and S. Oglesby and G. Nichols, *Electrostatic Precipitation,* Marcle-Dekker, N.Y., 1978.

Improvements in conventional ESP technology are disclosed in the patent literature. In the Environmental Protection Agency's ("EPA") U.S. Pat. No. 4,885,139 entitled *Combined Electrostatic Precipitator and Acid Gas Removal System,* which is hereby incorporated by reference, an ESP is disclosed in which a neutralizing slurry is sprayed into a chamber in the ESP so as to react with acid gases upstream of electrostatic precipitation. In the ESP disclosed in U.S. Pat. No. 4,885,139, the electrostatic collector section in a first section of the ESP is removed and replaced with a set of spray nozzles for injection of aqueous droplets of an acid gas neutralizing agent. The neutralizing agent is disclosed as being a slurry for calcium-based sorbents such as calcium carbonate or a clear solution with sodium-based sorbents such as sodium bicarbonate. The aqueous acid gas neutralizing agent is sprayed into the gas passing through the housing at a point upstream of the electrostatic collector section. U.S. Pat. No. 4,885,139 discloses that upon removing one electrostatic collector section to make room for neutralizing agent spray nozzles, it is necessary that the remaining electrostatic collector sections be upgraded with prechargers to restore the original particulate collection efficiency and to collect the injected sorbent.

EPA's U.S. Pat. No. 5,059,219 entitled *Electroprecipitator with Alternating Charging and Short Collector Sections,* which is hereby incorporated by reference, discloses a high efficiency ESP with multiple alternating charging and short collector sections. The ESP disclosed in U.S. Pat. No. 5,059,219 improves particulate removal efficiency by application of alternating charger and short collection sections. In an ESP with alternating charging and short collector sections, removal efficiency is improved by separating the functions of particulate charging and particulate collection.

In ESP systems with alternating charging and short collector sections, particulates passing through the ESP are charged in the charging section. The charger accomplishes this end by maximizing both the electric field and the current density present in the charger section. The high electric field makes it possible for the particulates to hold a relatively high charge. The high current density makes more charge available in the gas stream for charging particulates. The combination of a small diameter corona discharge electrode and large diameter grounded collector electrode in the charger section yields the desired electric field and current density.

When particulates passing through ESPs with alternating charging and short collector sections have high resistivities, the high current density in the charger section may result in a "back corona" phenomenon in the layer of particulates gathered on the grounded collector electrodes of the charging section. "Back corona" occurs when high resistivity particulates gathered on the collector electrode give rise to an increased electric field across the layer of particulates. This electric field can be sufficient to generate positive ions in the air spaces within the layer of particulates. Under "back corona" conditions, these positive ions tend to migrate back into the gas stream where they neutralize the negative charge on particulates, which in turn reduces the collection efficiency of the ESP. To overcome the "back corona" problem, the collector electrodes in the charging section of known ESP systems with alternating charging and collector sections are cooled, as for example be passing cooling water through the grounded electrodes of the charging section, so as to reduce the resistivity of particulates gathered on the collector electrodes of the charging section.

On the other hand, in the collector sections of known ESPs with alternating charging and collector sections, performance is optimized by maximizing the electric field while providing a minimal current density just sufficient to maintain electrostatic adherence of collected particulates to the grounded collector plates. The high electric field improves particulate collection because the force driving the particulates to the grounded collector plates of the collector section is proportional to the charge on the particles and the magnitude of the electric field. The current density is kept low to avoid "back corona" in the vicinity of the collector section grounded plates. When a small corona current flows from the corona discharge electrodes in the collector section to the grounded collector plates, an electric field develops in the layer of particulates on the collector plates. This field provides a clamping force that keeps particulates on the collector plates and prevents their reentrainment into the gas stream.

Due to the difference in desirable operating conditions between the charging and collector sections, the charging sections are conventionally placed a short distance upstream of the corresponding collector section so as to not interfere with the collection of particulates. However, this has proved structurally difficult because the collector electrodes of the charging and collector sections must be separately supported within the ESP and because the collected particulates must be separately removed, conventionally by mechanical rapping or scraping, from the grounded electrodes of the charging and grounded collector plates of the collector section. This structural arrangement frequently results in high maintenance and operating costs. In addition, separating the charging and collector sections tends to increase the size of the ESP.

SUMMARY OF THE INVENTION

Accordingly, it is an object of the invention to provide an apparatus and process for removing acidic gas and particulate matter from a gas stream passing through an ESP that can more efficiently collect a multiplicity of particulate and gaseous pollutants.

A further object of the invention is to provide an ESP that can remove acid gases and gas toxics without requiring more space than is available in existing ESPs.

Another object of the invention is to provide an ESP that removes both particulates and acid gases from a gas stream and renders usable byproducts.

A still further object of the invention is to provide an ESP of high efficiency and high durability that is able to maintain a record of superior performance over an extended period of time.

Additional objects and advantages of the present invention will be set forth in part in the description that follows and in part will be obvious from the description or may be learned by practice of the invention. The objects and advantages of the invention may be realized and obtained by the apparatus particularly pointed out in the appended claims.

To achieve the objects and in accordance with the purpose of the invention, as embodied and as broadly described herein, an ESP is provided having an electrostatic collector section with discharge electrodes positioned between pairs of grounded collector electrodes, a gas entry port located upstream of said electrostatic collector section, and a section between the gas entry port and said electrostatic collector section into which an aqueous acid gas neutralizing agent is sprayed into the gas stream entering the ESP through the gas entry port, the moisture content of the acid gas neutralizing agent being sufficient to reduce the resistivity of particulates in the gas stream and to increase the density of the gas to a level such that the flow rate of the gas through the electrostatic precipitator is reduced. An additional collector section may be interposed between the gas entry port and the point where the acid gas neutralizing agent is injected into the gas stream to remove particulates prior to introduction of the neutralizing agent. The collector section may comprise alternating charging and short collection sections in which the grounded electrodes of adjoining charger and collector sections are connected. A liquid spray may be further introduced to remove particulates collected on the grounded electrodes of the collector sections.

The accompanying drawings, which are incorporated in and constitute a part of this specification, illustrate presently preferred embodiments of the invention, and, together with the description, serve to explain the principles of the invention.

DESCRIPTION OF THE PREFERRED EMBODIMENT

Figure 1:
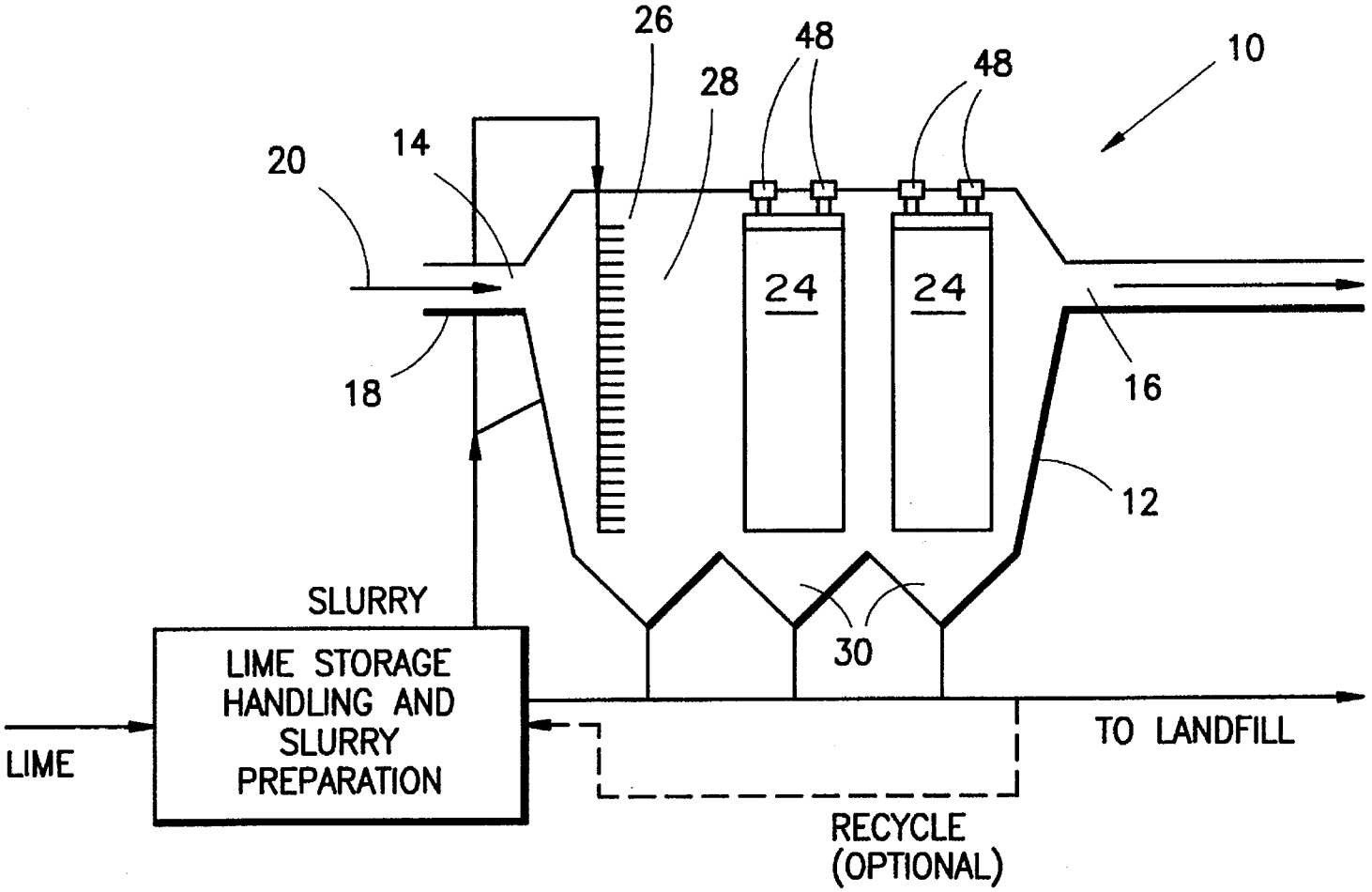
FIG. 1 is a schematic representation of an ESP according to one preferred embodiment of the invention.

Reference will now be made in detail to the presently preferred embodiments of the invention, examples of which are illustrated in the accompanying drawings. Throughout the drawings, like reference characters are used to designate like elements.

According to the present invention, there is provided an electrostatic precipitator 10 having a housing 12, a gas entry port 14, and a gas exit port 16. Ductwork 18 is arranged to carry a gas 20 from a gas generator (not shown) to gas entry port 14 of ESP 10. The gas generator may be any source of gas laden with particulates, acid gases or other toxics that need to be removed from the gas. For example, gas generators may include coal-fired electric power plants, incinerators, pulp and paper mills, and metallurgical and chemical production processes.

The ESP of the invention is provided with an electrostatic collector section that is preferably comprised of discharge electrodes 48 positioned between pairs of collector electrodes 24. Discharge electrodes 48 are connected to a D.C. power supply and may comprise electrode wires hanging between collector electrodes 24. Collector electrodes 24 are preferably flat metal plates comprised of an electrically conducting material. The collector electrodes may be connected to the positive terminal of the D.C. power supply for discharge electrodes 48, may be otherwise provided with a charge opposite to that of the discharge electrodes 48, or may simply be connected to ground. Particulates in the gas passing through each collector electrode section are charged and repelled by the discharge electrodes 48 and attracted to and adhere to the collector electrodes 24. Once on the collector electrodes, the particles are removed by any conventional means, such as by mechanical rapping (not shown) to fall into a hopper 30 at the base of the electrostatic collector section. The collected particulates are ordinarily removed to a landfill.

Removal of acid gases, such as $SO_2$, is achieved by spraying an acid gas neutralizing agent through nozzles 26 into the gas stream passing through the ESP at a point upstream of the electrostatic collector section. EPA's U.S. Pat. No. 4,885,139 teaches that the introduction of an acid gas neutralizing agent into an ESP to remove acid gases requires the addition of prechargers on the electrostatic collector sections in order to maintain the performance of the ESP under the increased load imposed by the sorbent injection.

According to the present invention, an aqueous acid gas neutralizing agent is sprayed into an ESP that does not include prechargers on the electrostatic collector sections. It has been discovered that there are a number of ways to introduce an acid gas neutralizing agent into an ESP in a manner that does not require prechargers on the collector sections and that does not significantly reduce the collection efficiency of the ESP.

According to the embodiment of the invention shown in FIG. 1, neutralizing agent is injected into an ESP that has been retrofitted for control of acid gases. A liquid neutralizing agent is introduced as a spray through nozzles 26 that are installed in a portion of the ESP upstream of the collector sections. The neutralizing agent may be any alkali agent that neutralizes acid gases such as $SO_2$. For example, the neutralizing agent may be a slurry containing calcium-based sorbents such as slaked calcium oxide or it may be a clear solution containing sodium-based sorbents such as sodium carbonate. Alternatively, the neutralizing agent may comprise a free flowing substance made up of particles having high surface areas, high porosities and high moisture contents. Preferably, such alternative neutralizing agents have surface areas greater than 30 $m^2/g$ and are capable of carrying a mass of water equal or greater than their own mass. An example of such an alternative free flowing sorbent would be a non-crystalline calcium aluminum silicate with a moisture content between 5% and 50%, as disclosed in U.S. Pat. No. 5,047,221.

In the embodiment of the invention shown in FIG. 1, neutralizing agent is injected through nozzles 26 that have been installed in a first section 28 of the ESP from which collector electrodes have been removed. Preferably, the diameter of the droplets sprayed from nozzles 26 is between 10 and 100 micrometers. The evaporation from the injected aqueous sorbent cools the gas stream which, in turn, increases the density of the gas so as to decrease the volumetric flow rate of the gas passing through the downstream collector section. Preferably, the flow rate of the gas through the ESP after the spraying of the neutralizing agent is initiated is at least 10% below the flow rate before spraying, with no other changes in process conditions. The reduction in gas flow rate increases the removal efficiency of the electrostatic collector sections such that satisfactory operation can be maintained without the need for collector section particle prechargers. Satisfactory performance without prechargers is best maintained in large ESPs.

Satisfactory ESP performance with neutralizing agent injection and no collector section prechargers can generally be achieved when the ratio of the collecting electrode area to the volumetric flow rate, following the point of sorbent injection, is approximately 40 seconds/meter (measured when the ESP is operated with the sorbent injection turned off). The precise operating point at which prechargers become unnecessary is dependent upon particle size distribution and loading, particle resistivity, the design parameters of the electrostatic precipitator, and the ESP's electrical conditions. Computer modeling may be applied to predict the flow rate at which satisfactory removal efficiencies can be achieved without collector sections on the prechargers. One computer model that is well suited for such work was developed by Research Triangle Institute with EPA support and is available from the National Technical Information Service as PB92-502-251 (instruction manual PB92-169-614).

Figure 2:
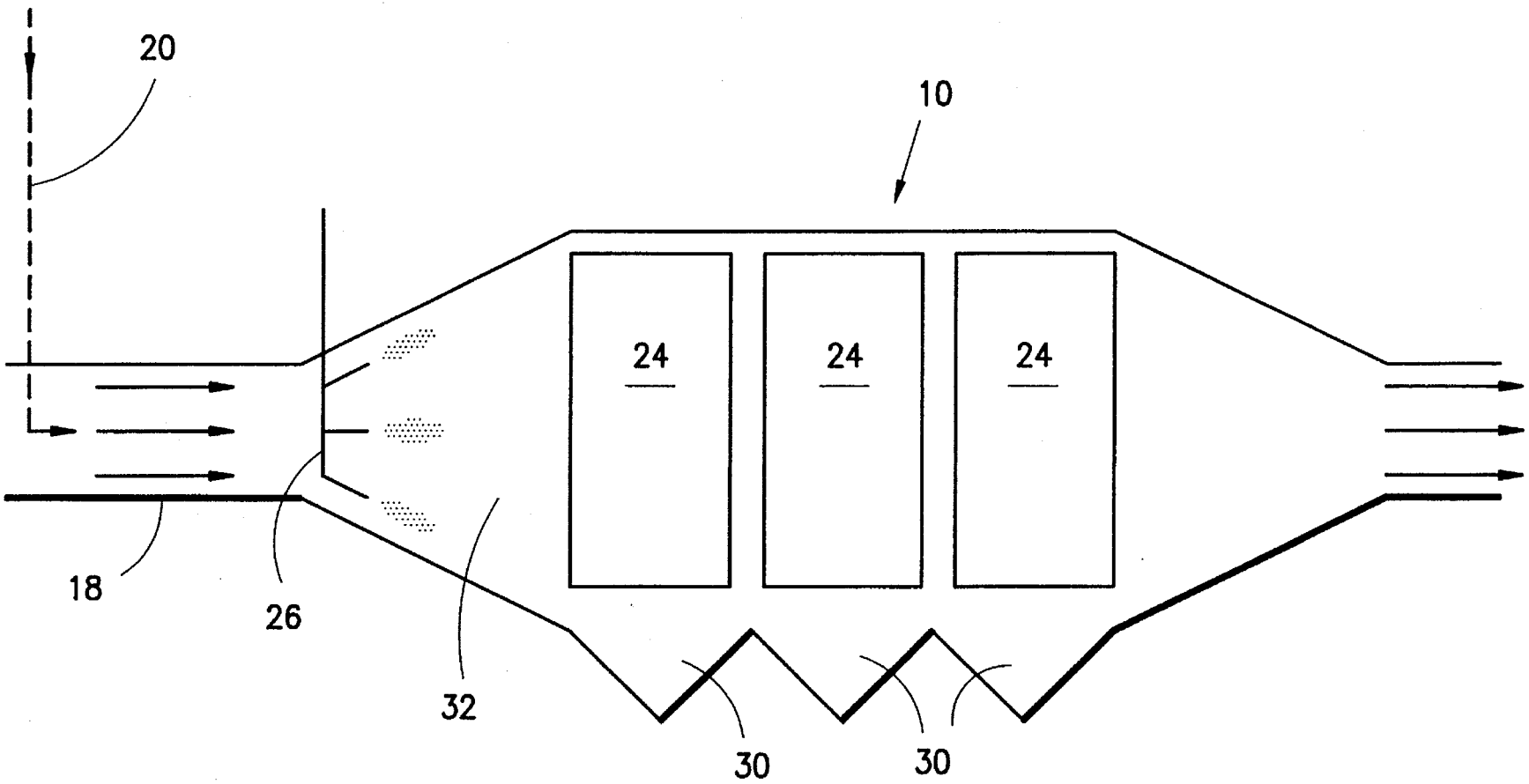
FIG. 2 is a schematic representation of an ESP according to a second preferred embodiment of the invention.

According to another embodiment of the invention, as shown in FIG. 2, an acid gas neutralizing agent can be introduced into the transition zone 32 of an ESP. ESPs are usually equipped with a transition zone 32 that connects the ductwork 18, which carries a gas to the ESP, to the much larger electrostatic collector sections of the ESP. It has been discovered that in many existing precipitators, sorbent can be injected into the ESP's inlet transition section. If dry collection methods are used in the collector section of the ESP, the residence time for particulates prior to entering the collector sections of the ESP must be sufficiently long for complete evaporation of water injected with the sorbent to take place. Use of the transition section for sorbent injection adds to the residence time for water evaporation and may reduce the length of existing electrostatic collector sections that must be removed when an ESP is retrofitted for acid gas removal. Thus, the ESP's particulate removal efficiency is better maintained.

In some instances it is desirable to have some segregation of collected particulates and collected neutralizing agent. This is the case when the sorbent material can be washed and recycled for repeat use. Segregation of collected particulates and reacted neutralizing agent is also desirable where the particulates or the reacted neutralizing agent can be more easily sold or disposed of in a segregated condition. In the embodiment of the invention shown in FIG. 3, neutralizing agent is injected through nozzles 26 into a reaction zone 34 located upstream of grounded collector electrodes 24 but downstream of upstream grounded collector electrodes 36. The upstream grounded collector electrodes 36 are part of one or more upstream collector sections, each comprised of discharge electrodes (not shown) between pairs of grounded collector electrodes 36. A large fraction of the particulates entering the ESP are collected on the upstream grounded collector electrodes 36. Preferably, the upstream grounded collector electrodes remove at least 50% of the particulates in the gas stream that enters the ESP, and more preferably remove at least 75% of such particulates. The collected particulates are removed from the upstream collector electrodes by conventional means such as rapping. The collected particulates fall into upstream hoppers 38 from which they are removed, via line 40, for subsequent use or disposal. Downstream collector grounded electrodes 24 collect spent neutralizing agent and particulates not collected by the upstream collector electrodes 36. Material collected on the downstream grounded collector electrodes 24 is collected in hoppers 30 by conventional means and is then removed, via line 42, for reuse, sale or disposal. Reuse of sorbent is best achieved when the acid gas neutralizing agent injected into reaction zone 34 is a solution of sodium-based sorbents that can be washed.

Gas and particulate matter entering an ESP may contain oxides of alkali metals such as calcium, sodium, or lithium. This can occur naturally, such as when the particulate matter is a fly ash from the combustion of coal containing large amounts of alkali metals. At other times the alkali metals are purposefully added either to the boiler or the ductwork upstream of the ESP, to react with acid gases. It has been found that the injection of aqueous neutralizing agent in the ESP humidifies the gas such that oxides of alkali metals present react with water vapor to form hydroxides of the alkali metals which, in turn, enhance acid gas removal because of neutralization by reaction between the acid and alkali.

The cooling experienced by the gas stream when aqueous sorbent injected into the ESP evaporates can result in the gas reaching its adiabatic saturation temperature. The cooling and moisture increase promotes the condensation of toxic species in the gas, including both organics and non-organics such as heavy metals. These condensed toxic species are then collected by the electrostatic precipitator with the particulates and the reacted neutralizing agent.

Another benefit of the gas cooling and humidification that occurs with the injection of an aqueous neutralizing agent is the lowering of the electrical resistivity of the particulate matter in the gas. The lowered resistivity makes the particulates more amenable to collection by electrostatic precipitation. The lowering of electrical resistivity results from improved electrical surface conduction that occurs with reduced temperature and increased moisture level. The resistivity reduction is a function of the particle characteristics and chemistry, the moisture level and the temperature.

Figure 4:
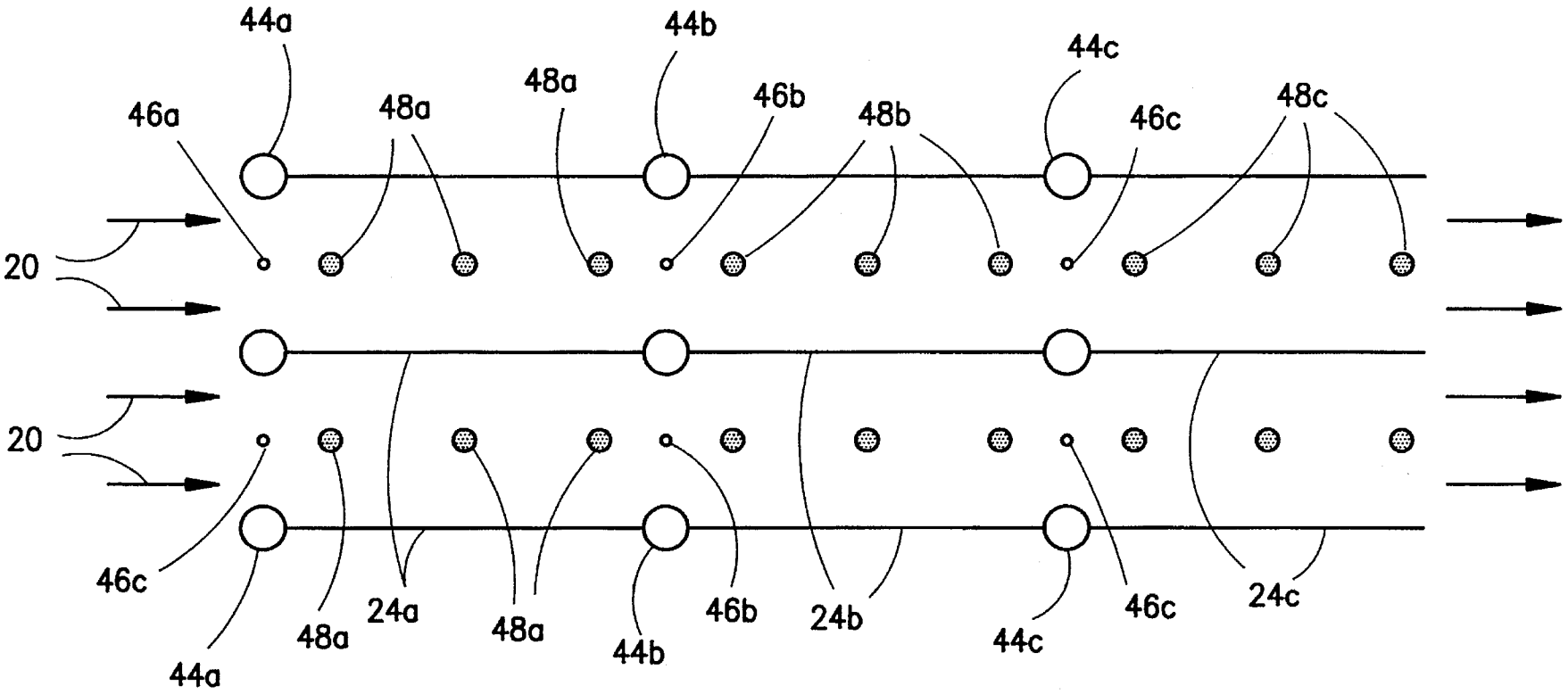
FIG. 4 is a plan view of a portion of the collector section of an ESP according to a fourth preferred embodiment of the invention.

Collection of particulates and reacted sorbent material with an ESP can be improved by use of a collector section having alternating charging and short collector sections in which the collector electrodes of the charging and short collector sections are connected to each other. According to the invention, an ESP is provided with alternating charging and short collector sections in which the grounded electrodes of the charging and collector sections are physically connected. As shown in FIG. 4, each of the ESP's charging sections includes a discharge electrode 46*a*, 46*b*, 46*c* and a grounded collector electrode 44*a*, 44*b*, 44*c*. The grounded collector electrodes are preferably made coolable, as for example by passing cooling water through the core of the collector electrodes, in order to decrease the resistivity of particulates gathered on the collector electrode. Each of the collector sections includes corona discharge electrodes 48*a*, 48*b*, 48*c* disposed between pairs of grounded collector plates 24*a*, 24*b*, 24*c*. Maximum ESP efficiency is achieved when the chargers of each charger section are energized by their own high voltage electrical supply and the sets of corona discharge electrodes of each collector section are energized by their own high voltage source. Such separate voltage sources make it is possible to apply optimum electric fields to charging and collector sections to match the reduction of particulate concentration that results from collection.

The grounded electrodes of the alternating charging and collector sections are mechanically coupled, as shown in FIG. 4, such that each collector plate is fastened to the adjacent grounded electrode of the charging section just upstream of the collector section grounded collector electrode. In addition, each collector section grounded electrode, except the grounded electrodes in the last collector section through which the gas stream passes before exiting the ESP, is fastened to the adjacent grounded electrode of the charging section just downstream of the collector section. The charging and collector section grounded electrodes may be fastened to each other by welding, bolting or any other method known to fabricators of ESPs. The mechanically coupled grounded charging and collector electrodes form a rigid assembly that can be mechanically rapped as one unit to remove collected particulates. This rigid assembly is also more compact than prior art ESPs with alternating charging and collector sections. Although FIG. 4 shows three alternating charging and collector sections, the invention may be applied to ESPs having a greater or fewer number of charging and collector sections. Likewise, it is anticipated that the present invention could be applied to an ESP having any number of additional parallel gas flow lanes.

Preferably, each of the charging and collector section discharge electrodes 46 and 48 are located on the center line between the pairs of parallel grounded electrodes that define each gas flow lane. The diameter of the charging section grounded electrodes is preferably between 15% and 35% of the center-to-center distance between the two charging section grounded electrodes that define the gas flow path of each charging section, and is more preferably between 25% and 30% of the center-to-center distance. The diameter of each charging section corona discharge electrode is preferably approximately 3 mm. The diameter of each collector section discharge electrode is preferably between 6 and 10 mm. The length of each collector section grounded electrode 24 in the direction of gas flow is preferably between two and four times the spacing between the grounded collector electrode plates, and is more preferably approximately three times the spacing between the electrode plates. Typical collector section lengths in the direction of gas flow are in the range of 0.2 to 1.3 meters.

Figure 5:
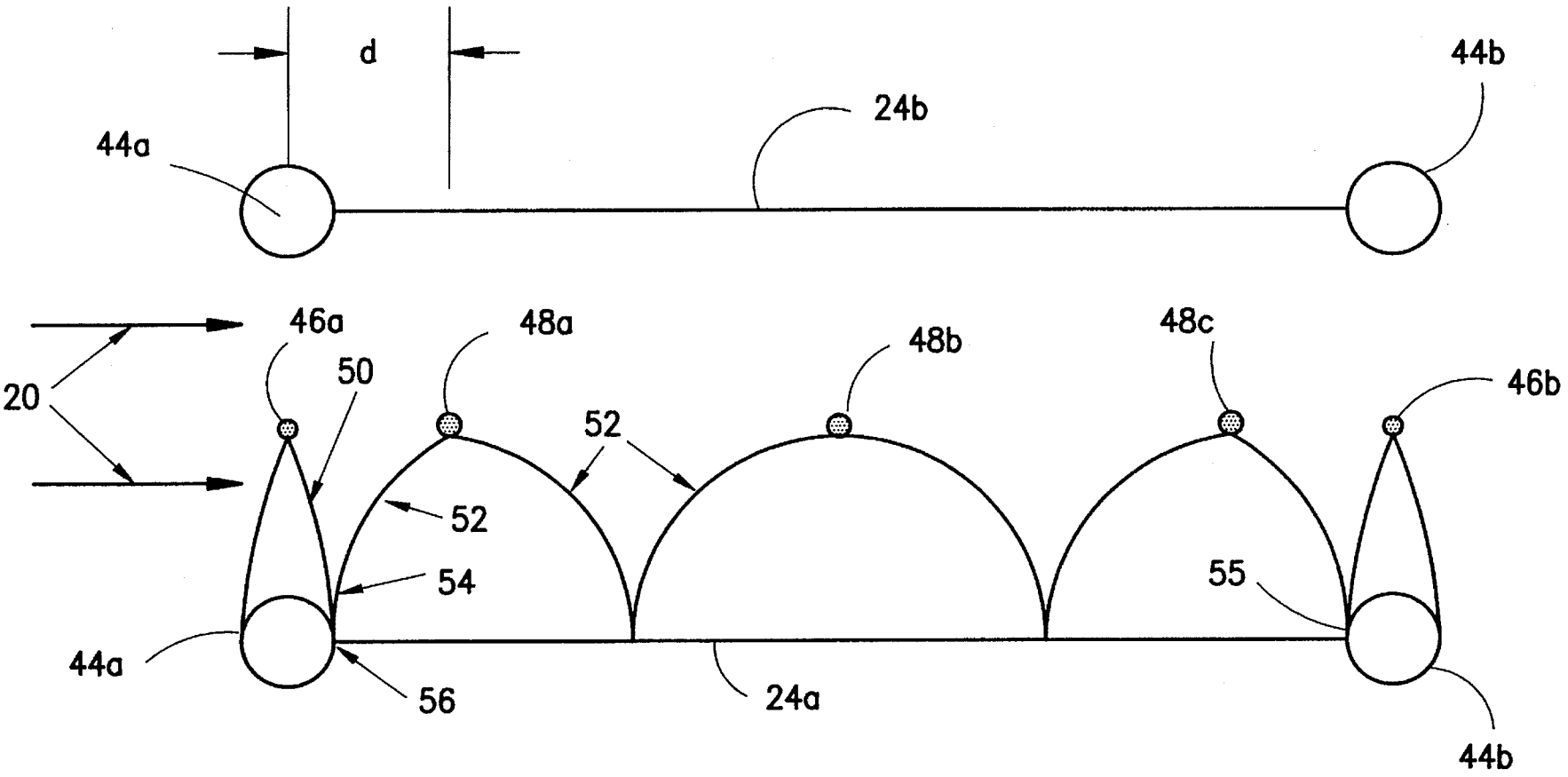
FIG. 5 is a plan view showing electric field lines representing the electric field generated by one configuration of the ESP collector section shown in FIG. 4.

Connecting the grounded electrodes of the charging and collector sections imposes stringent electrical design requirements on the ESP. As shown in FIG. 5, the electric field between charging section discharge electrode 46*a* and charging section grounded electrode 44*a* can be represented by the electric field lines 50. Similarly, the electric field between the collector section corona discharge electrodes 48*a* and grounded collector plates 24*a* can be represented by the electric field lines 52. As shown, the electric field lines emanate from each of the discharge electrodes and terminate on a grounded surface. Electric field lines emanating from two discrete discharge electrodes intersect, but they do not cross each other. The outermost electric field lines emanating from adjacent discharge electrodes 46*a* and 48*a* intersect the grounded electrode at a point 54, but do not cross. Similar electric field lines (not shown) emanate from discharge electrodes 46*a* and 48*a* in the direction of the opposite grounded electrodes of the gas flow lane.

Figure 6:
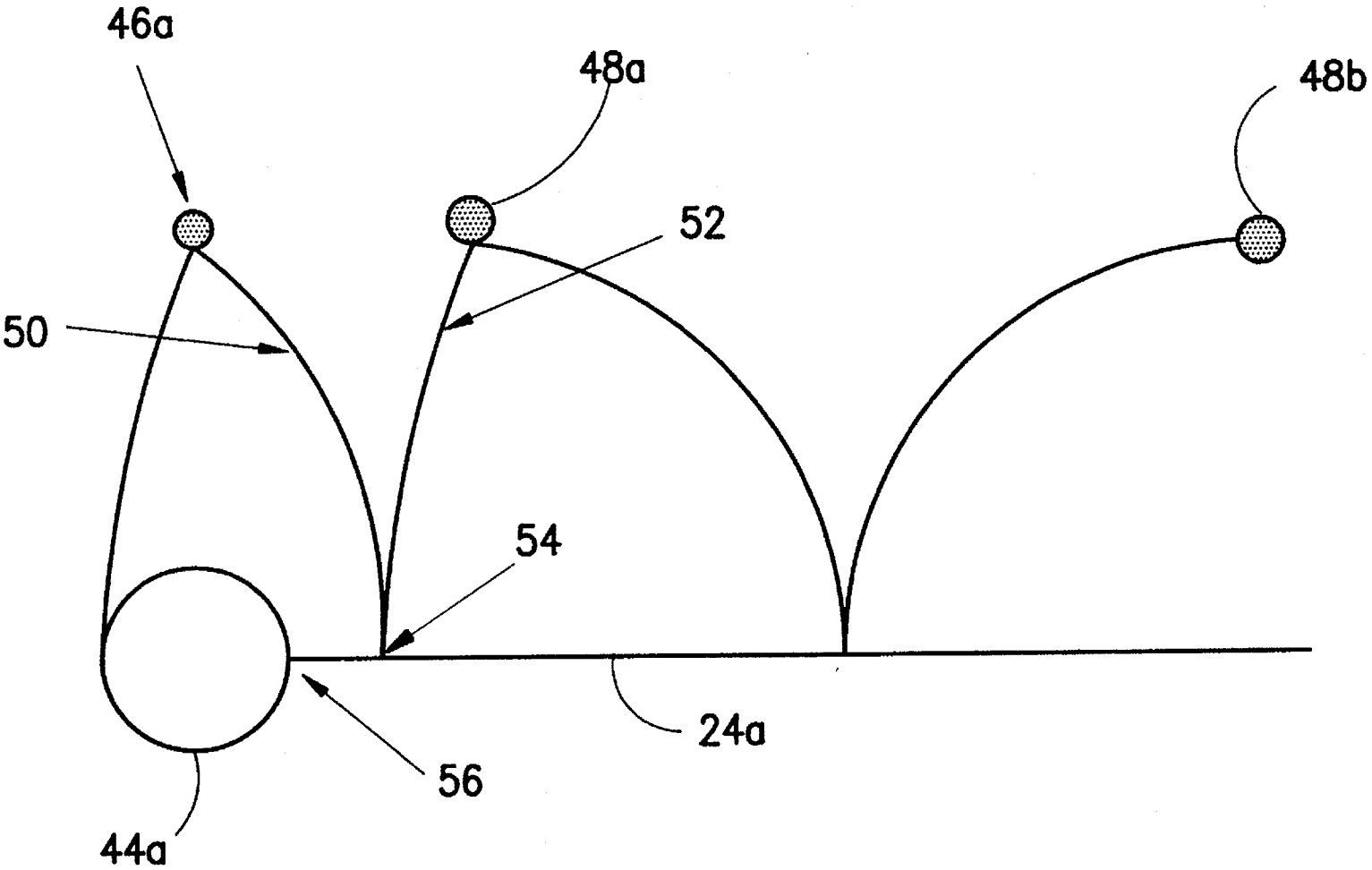
FIG. 6 is a plan view showing electric field lines representing the electric field generated by another configuration of the ESP shown in FIG. 4.

For the reasons discussed in the background portion of the application, it is desirable that the current from charging section discharge electrode 46*a* be directed to charging section grounded collector electrode 44*a* and not to the uncooled collector section grounded electrode 24, where the high charging section current could cause "back corona." Current from charging section discharge electrode stays within the electric field generated by the discharge electrode. Accordingly, it is important that the electric field from each charging electrode be restricted to the corresponding charging section grounded electrode (as shown in FIG. 5), and not intrude onto the adjoining collector section grounded collector plate (as shown in FIG. 6). Under optimum particulate charging and particulate collection conditions, the intersection point 54 of the electric field lines 50 and 52 corresponds to the point 56 where the grounded collector plate 24*a* is joined to the grounded collector electrode 44*a*. The intersection point 54 can be caused to move to various points along grounded electrodes 44*a* and 24 by adjusting the voltage applied to charger section discharge electrode 46*a* and the adjacent collector section corona discharge electrode 48*a*, and by adjusting the distance "d" (as shown in FIG. 5) between the two discharge electrodes. In practice, the voltages are generally set at the maximum voltage at which neither sparking nor "back corona" occurs. Accordingly, the location of the electric field intersection point 54 is best positioned along the grounded electrodes by varying the distance "d" between charger section discharge electrode 46*a* and the adjacent downstream collector section discharge electrode 48*a*. In a similar manner, the intersection point 55 between the electric field generated by each charging section after the first charging section in an ESP and the electric field generated by the adjacent upstream collector section discharge electrode is adjusted by varying the distance between charging section discharge electrode 46*b* and the adjacent upstream collector section discharge electrode 48.

The distance "d" in FIG. 5 is determined by computing electric fields using methods and techniques, such as finite element analysis, known to designers of electrostatic precipitators. Computer modeling software is commercially available for making such computations. The distance "d" is generally 25% to 75% of the distance between the grounded collector electrode plates. Once the distance "d" between a charging section discharge electrode and the adjacent downstream collector section discharge electrode is determined and the distance "d" between the next downstream charging section discharge electrode and the adjacent upstream collector section discharge electrode is determined, the remaining collector section discharge electrode(s) are preferably spaced at equal distances between the two end discharge electrodes of the collector section. After the electrode distances are established the particulate collection efficiency is computed by modeling techniques known to electrostatic precipitator designers. One computer model highly suited for such computations was developed with funding from the Environmental Protection Agency and is available from the Department of Commerce's National Technical Information Service under the name "ESPVI 4.0" (Software NTIS No. PB92-502-251; Manual NTIS No. PB92-169-614).

Figure 7:
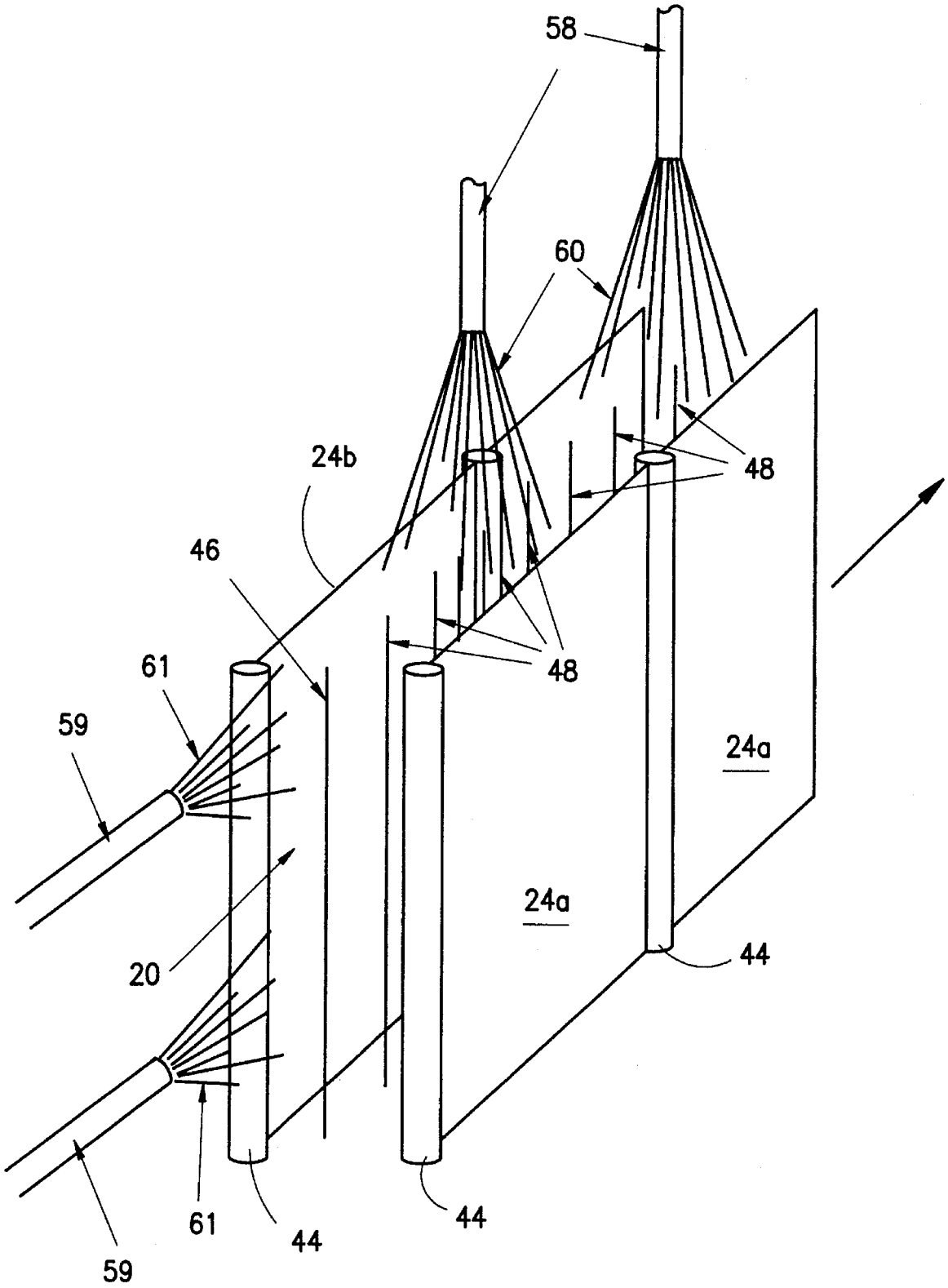
FIG. 7 is a perspective view of a portion of the charging and collector sections of an ESP according to a fifth preferred embodiment of the invention.

According to the invention, the electrode collector sections preferably include spray means for removing particulates, unreacted neutralizing agent and neutral salts from the grounded electrodes of the collector sections. As shown in FIG. 7, spray nozzles 58 may be applied to spray a mist 60 onto the grounded collector electrodes to remove particulates collected on the electrodes. Spray collection replaces mechanical rapping methods for removing particulates from the electrode plates. Additional spray nozzles 59 may be positioned within the gas stream to spray mist 61 in the direction of gas flow. The spray from nozzles 58 and 59 may be continuous or intermittent, and additional or fewer spray nozzles may be applied, depending upon the quantity of particulate matter to be flushed away, and the need to prevent dry areas from forming on the grounded electrodes.

Use of a spray to remove particulates eliminates the problem of particulates being reentrained in the gas stream after they have come into contact with one of the grounded collectors. In addition, wet operation reduces the resistivity of high resistivity particulates such that "back corona" problems are eliminated, making it unnecessary to cool the grounded electrodes in charging sections. Spray collection may be applied to conventional electrostatic collector plates of the type shown in FIGS. 1–3, or to electrostatic collectors with alternating charging and short collector sections of the type shown in FIGS. 4 and 7. Spray collection is especially well suited for ESPs having alternating charging and short collection sections in which the grounded collectors of the charging and collector sections are interconnected as shown in FIG. 4. This is because the compact design and contiguous collector sections simplifies the spraying of liquid onto the collecting surfaces and helps assure that efficiency disrupting wet/dry particulate interfaces do not occur on the collecting surfaces. Applicants have found that operating an ESP having alternating charging and short collector sections using wet spray collection emits about one third of the particulates that would be emitted if particulates were collected using dry collection methods.

Figure 3:
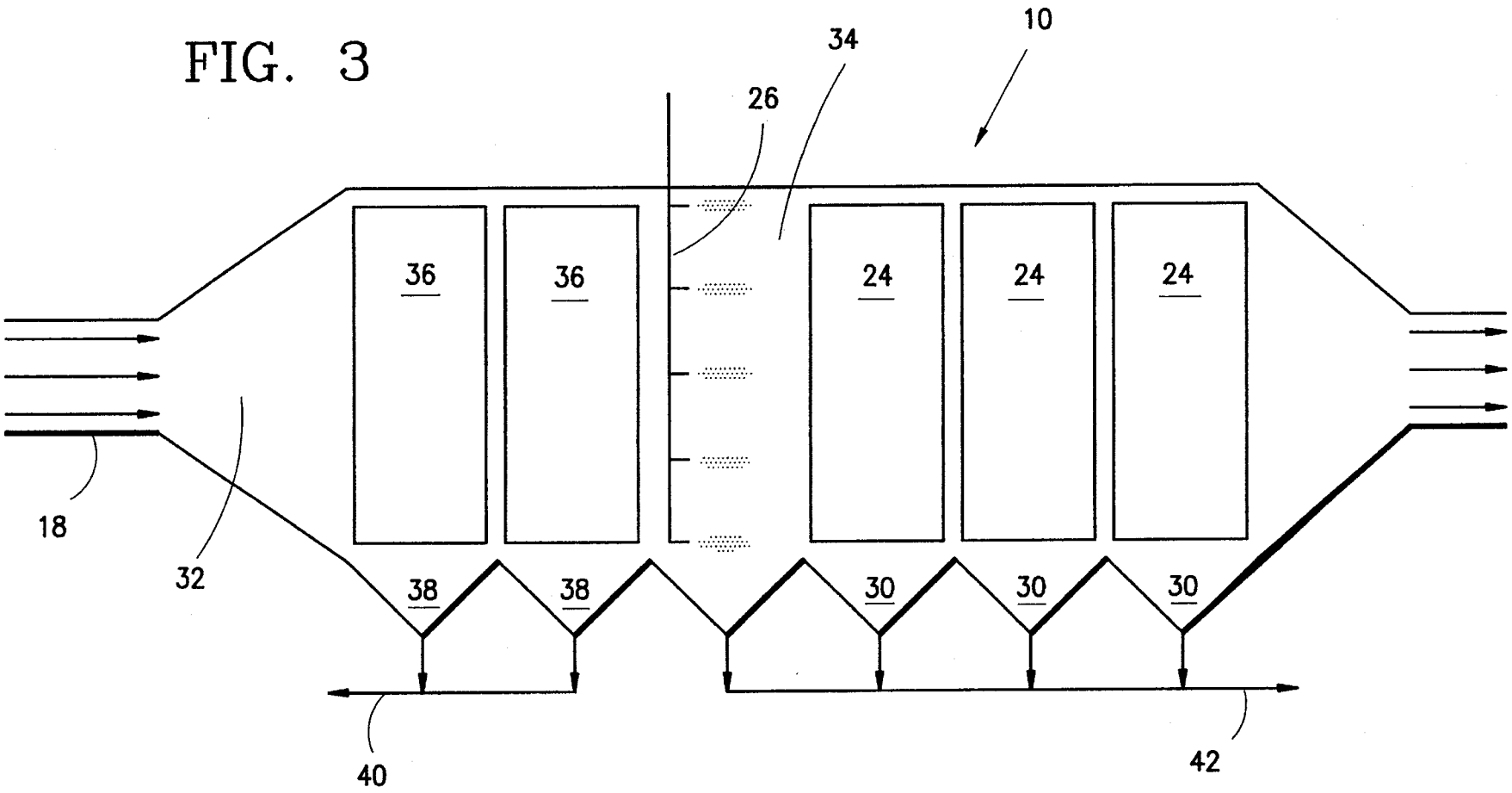
FIG. 3 is a schematic representation of an ESP according to a third preferred embodiment of the invention.

Spray collection is also well suited for ESPs in which an acid gas neutralizing agent is injected into the ESP to neutralize acid gases, as shown in FIGS. 1–3. Because collection is wet, it is not necessary that the droplets of the acid gas neutralizing agent dry before they reach the collector section of the ESP as is the case when dry collection methods are used. This permits the ESPs to be made more compact than would otherwise be possible where an acid gas neutralizing agent is injected directly into the ESP to treat acid gases. Rather, the moisture from the acid gas neutralizing agent has the desirable effect of saturating the gas stream with water such that drying is less likely to occur on the grounded collector plates within the collector section. In addition, injection of a neutralizing agent reduces corrosion that would otherwise result from acids that would be formed from the interaction of acid gases and the water spray. Corrosion can be further reduced and acid gas treatment further improved by adding an alkaline acid gas neutralizing agent to the water injected through collector section nozzles 58 and 59.

It has also been found that acid gas capture in an ESP by acid gas neutralizing agents, such as calcium based sorbents, and the utilization of such neutralizing agents is markedly improved when the droplets of the neutralizing agent are permitted to remain wet throughout the ESP. Once a calcium based sorbent droplet dries the neutralization reaction generally ceases. A wet-operated ESP allows for sustained dissolution of calcium sorbents which improves both acid gas capture and sorbent utilization. For example, the collection efficiency of a calcium based system for $SO_2$, an acid gas pollutant, is improved from 50–60% to 85–90% by using a wet rather than a dry collection system.

Figure 8:
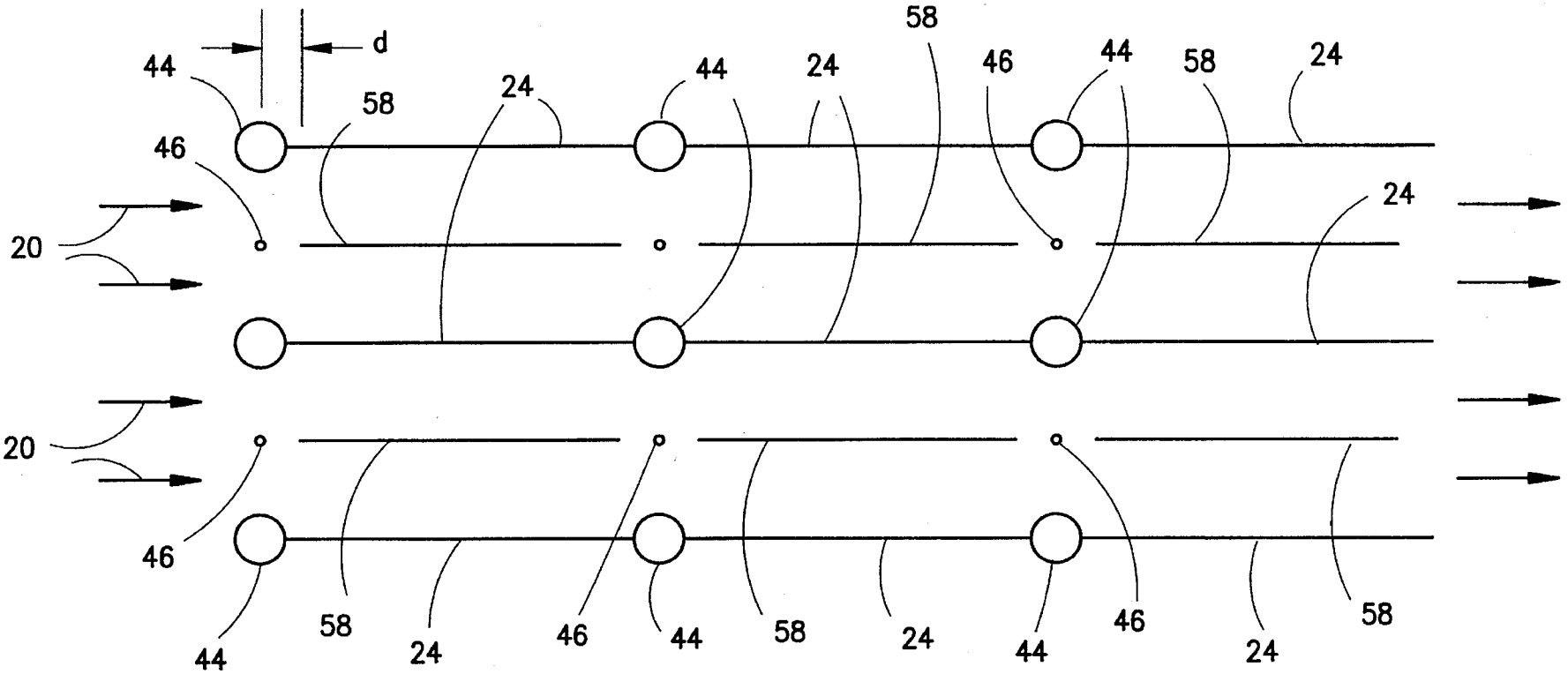
FIG. 8 is a plan view of a modified embodiment of the ESP collector section shown in FIG. 4.

According to another preferred embodiment of the invention, an ESP is provided in which the collector section includes electrically charged plates for generating an electric field within the collector section of the ESP. The alternating charging and collector sections of such an ESP are shown in FIG. 8. Each charging section is comprised of a charging electrode 46 and a pair of grounded electrodes 44. In this embodiment of the invention, each collector section is comprised of a charged electrode plate 58 disposed between a pair of grounded collector plates 24. Electrode plates 58 are preferably located midpoint between the grounded collector plates 24 that define each gas flow lane. Electrode plates 58 are comprised of an electrically conducting material, are preferably approximately the same height as the grounded collector plates, and are also preferably no longer than the grounded collector plates in the direction of gas flow. Setting the distance "d" between the charging electrodes 46 and adjacent flat plate electrodes 58, as shown in FIG. 8, to assure that all of the electric field lines from the charging electrodes 46 terminate upon the grounded electrodes 44 is by the same technique described previously with regard to FIG. 5. The high voltage with which the electrode plates 58 are charged is of the same polarity as the charging electrodes 46. The collection efficiency is determined by established electrostatic precipitator modeling programs such as ESPVI 4.0, previously described.

The high voltage charged electrode configuration that produces the highest electric field in the gas stream flow lanes is a flat plate, as for example plate 58 of FIG. 8. However, flat plate electrodes do not produce any corona current which is needed to clamp particulates collected on the grounded collector plates 24 to those collector plates and prevent particle reentrainment into the gas stream. Accordingly, the flat plate collector section electrodes of the embodiment of the invention shown in FIG. 8 are combined with the wet spray particulate collection methods described above. Because wet collection of particulates prevents reentrainment of particulates, regardless of whether a corona current is present, the higher electric field produced by flat plate electrodes can be used to improve particulate collection efficiency without ill effect. The collector plates may be irrigated using the spray nozzle arrangement described with regard to FIG. 7, with the alternative spray nozzle configuration of FIG. 9 or with any other equivalent wetting arrangement. In-stream nozzle 60 of FIG. 9 may be used to spray the grounded collector plates of the charging and collector sections and to saturate the gas stream. The embodiment of the invention shown in FIG. 8 can similarly be combined with the injection of an acid gas neutralizing agent into the ESP as described with regard to FIGS. 1–3 and 7.

Figure 9:
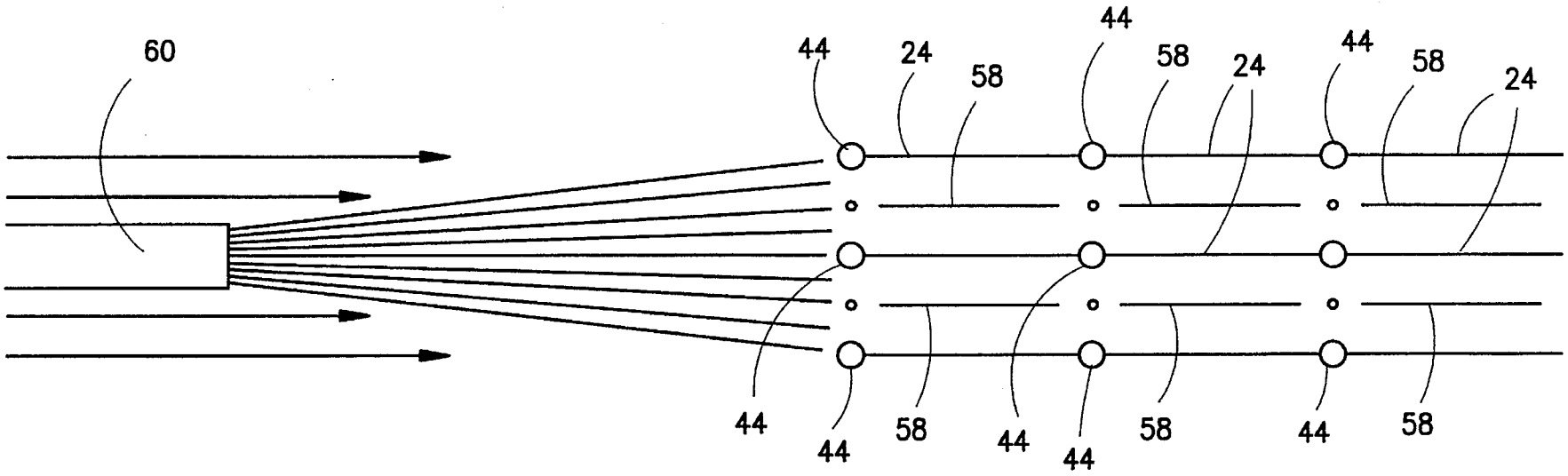
FIG. 9 is a plan view of another modified embodiment of the ESP collector section shown in FIG. 4.

Applicants have discovered that when flat plate high voltage electrodes are utilized in an ESP as shown in FIGS. 8 and 9, each of the collector section charged electrodes can be energized by one high voltage power source without loss of efficiency. This is because the absence of current flow from the flat high-voltage electrodes makes the collector sections insensitive to the changing electrical conditions, from section-to-section, that results from the decreasing particulate concentration in the gas stream.

It will be apparent to those skilled in the art that modifications and variations can be made in the ESP of this invention. For example, the invention could be applied to ESPs having vertical gas flow in a manner similar to its application to the horizontal gas flow ESPs shown in the drawings. The invention in its broader aspects is, therefore, not limited to the specific details, representative methods and apparatus, and illustrative examples shown and described herein. Thus, it is intended that all matter contained in the foregoing description or shown in the accompanying drawings shall be interpreted as illustrative and not in a limiting sense.

What is claimed:

1. A process for removing acidic gaseous contaminants and particulates from a gas comprising:

providing an electrostatic precipitator including at least one charging section and at least one electrostatic collector section disposed downstream of said charging section, within a housing defining a gas flow path; said electrostatic collector section having a plurality of parallel grounded collector electrode plates defining a plurality of gas flow lanes therebetween and a plurality of charged electrode plates parallel to said grounded collector electrode plates and centered within respective gas flow lanes; said charging section having a linear array of alternating discharge electrodes and grounded collector electrodes transverse to the gas flow path, said grounded collector electrodes each being mechanically joined to a terminal end of at least one grounded collector electrode plate; a gas entry port in said housing and upstream of said charging section; a transition zone between said gas entry port and said charging section; a gas exit port in said housing and downstream of said electrostatic collector section; and duct means, outside said housing, for conveying acidic gas discharged from a gas generating means to said gas entry port;

spraying an aqueous acid gas neutralizing agent into the gas passing through said housing at a point within said transition zone upstream of said electrostatic collector section, moisture content of said acid gas neutralizing agent being sufficient to reduce resistivity of particulates in the gas and to increase density of the gas;

passing said gas through said transition zone being of sufficient length for said neutralizing agent and the acidic gases to react and form neutral salts;

then passing said gas through said charging and electrostatic collector sections;

collecting the particulates on the grounded collector electrode plates of said electrostatic collector section thereby purifying the gas before the gas passes through the gas exit port; and spraying said grounded collector electrode plates with water to remove the particulates, unreacted neutralizing agent and the neutral salts collected on the grounded collector electrode plates.

2. The process of claim 1 further comprising:

applying a first voltage between discharge electrodes and grounded collector electrodes in said charging section; and applying a second voltage between said grounded collector electrode plates and said charged electrode plates in said electrostatic collector section, said second voltage being different from said first voltage and establishing an electric field without current flow between each of said charged electrode plates and adjacent grounded collector electrode plates.

3. The process of claim 2 wherein said charged electrode plates are shorter than said grounded collector electrode plates and have upstream terminal ends spaced from terminal ends of the grounded collector electrode plates by a distance d in the direction of the gas flow path; and wherein said first voltage establishes electric field lines from said discharge electrodes all of which terminate upon adjacent grounded collector electrodes.

4. An electrostatic precipitator comprising:

a housing defining a gas flow path;

a gas entry port through which gas enters said housing;

duct means, outside said housing, for conveying a gas discharged from a gas generating means to said gas entry port;

a gas exit port through which gas is discharged from said housing;

a plurality of collector sections disposed in said housing and located between said gas entry port and said gas exit port, each comprising a plurality of parallel, grounded collector plates, said grounded collector plates having an upstream end oriented in the direction from which gas is flowing from said gas inlet port and a downstream end oriented in the direction toward which gas is flowing to the gas exit port, said grounded collector plates being spaced by a distance $\delta$ to define a plurality of gas flow lanes therebetween, said grounded collector plates defining the length of said collector section as between $2\delta$ and $4\delta$ in the direction of gas flow, and at least one collector section corona discharge electrode located within each gas flow lane between the parallel grounded collector plates;

a plurality of charging sections alternating in series with said collector sections, each collector section being immediately preceded by a charging section, each of said charging sections comprising a linear array, aligned transverse to said gas flow path, of a plurality of charging section corona discharge electrodes and charging section grounded collector electrodes alternating with said charging section discharge electrodes;

wherein the upstream ends of the grounded collector plates of each collector section are each mechanically connected to one of the grounded collector electrodes of the charging section just upstream of the collector section, and wherein the downstream ends of the grounded collector plates of each collector section, except for the grounded collector plates of the collector section that is the last collector section through which gas passes before passing through the gas exit port, are each mechanically connected to one of the grounded collector electrodes of the charging section just downstream of the collector section;

means for applying a first voltage to establish first electric field lines extending from each of said charging section corona discharge electrodes to adjacent charging section grounded collector electrodes, but not to the grounded collector plates; and means for applying a second voltage to establish second electric field lines extending from said collector section corona discharge electrode to adjacent grounded collector plates, but not to charging section grounded collector electrodes.

5. The electrostatic precipitator of claim 4 wherein each of said charging section discharge electrodes is spaced a distance d from the nearest adjacent collector section discharge electrode, wherein d is between 0.25δ and 0.75δ.

6. The electrostatic precipitator of claim 4 wherein the length of each collector section in the direction of gas flow is between 0.2 and 1.3 meter.

7. The electrostatic precipitator of claim 4 wherein said plurality of collector sections comprises at least three collector sections.

8. The electrostatic precipitator of claim 4 further comprising spray means in each of said collector sections for spraying said grounded collector plates with water to remove particulates collected on the grounded collector plates.

9. The electrostatic precipitator of claim 8 further comprising spray means in each of said charging sections for spraying said charging section grounded collector electrodes with water to remove particulates collected on the charging section grounded collector electrodes.

10. The electrostatic precipitator of claim 5 wherein said first and second electric field lines respectively include first and second outermost field lines, and wherein d is set so that said first and second outermost field lines intersect, but do not cross at points where the upstream ends of the grounded collector plates attach to the grounded collector electrodes of the charging section.

11. A process for removing particulates from a gas comprising:

providing an electrostatic precipitator including at least one charging section and at least one electrostatic collector section disposed downstream of said charging section, within a housing defining a gas flow path; said electrostatic collector section having a plurality of grounded collector plates defining a plurality of gas flow lanes and a linear array of first corona discharge electrodes centered within each of said gas flow lanes; said charging section having a linear array of alternating second corona discharge electrodes and grounded collector electrodes transverse to said gas flow path, each of said grounded collector electrodes of said charging section being mechanically joined to a terminal end of at least one of said grounded collector plates of said electrostatic collector section; a gas entry port in said housing upstream of said charging section; a transition zone between said gas entry port and said charging section; a gas exit port in said housing downstream of said electrostatic collector section; and duct means, outside said housing, for conveying gas discharged from a gas generating means to said gas entry port;

passing the gas through said charging and electrostatic collector sections;

applying a first voltage to establish first electric field lines extending from each of the first corona discharge electrodes to adjacent grounded collector plates in said electrostatic collector section, but not to the grounded collector electrodes;

applying a second voltage to establish second electric field lines extending from each of the second corona discharge electrodes to the adjacent grounded collector electrodes in said charging section, but not to the grounded collector plates; and collecting particulates from the gas on the grounded collector plates of said electrostatic collector section, thereby purifying the gas prior to exit through the gas exit port.

12. The process of claim 11 wherein said first and second electric field lines respectively include outermost field lines which intersect but do not cross at a point defined by said mechanical joining.

13. An electrostatic precipitator comprising:

a housing defining a gas flow path;

at least one collection section within said housing, said collection section having a plurality of parallel grounded collector plates defining a plurality of gas flow lanes therebetween and a plurality of charged electrode plates parallel to said grounded collector plates and centered within respective gas flow lanes;

at least one charging section within said housing immediately upstream of said collection section, said charging section having a linear array of alternating discharge and grounded collector electrodes transverse to the gas flow path, said grounded collector electrodes each being mechanically joined to a terminal end of at least one grounded collector electrode plate;

means for applying a first voltage between said discharge electrodes and said grounded collector electrodes in said charging section;

means for applying a second voltage between said grounded collector plates and said charged electrode plates in said collection section, and establishing an electric field without current flow between each of said charged electrode plates and adjacent grounded collector plates; and spray means for washing collected particulates off said grounded collector plates in said collection section.

14. The apparatus of claim 13 wherein said charged electrode plates are shorter than said grounded collector plates and have upstream terminal ends spaced from nearest terminal ends of the grounded collector plates by a distance d in the direction of the gas flow path; and wherein said first voltage establishes electric field lines from said discharge electrodes all of which terminate upon adjacent grounded collector electrodes.

15. An electrostatic precipitator comprising:

a housing defining a gas flow path;

at least one collection section within said housing, said collection section having a plurality of parallel grounded collector plates defining a plurality of gas flow lanes therebetween and a linear array of first corona discharge electrodes centered within each of said gas flow lanes;

at least one charging section within said housing immediately upstream of said collection section, said charging section having a linear array of alternating second corona discharge electrodes and grounded collector electrodes transverse to the gas flow path, said grounded collector electrodes of said charging section each being mechanically joined to a terminal end of at least one of the grounded collector plates of said collector section;

a gas entry port in said housing upstream of said charging section;

a gas exit port in said housing downstream of said collection section;

means for applying a first voltage to establish first electric field lines extending from each of said first corona discharge electrodes to adjacent grounded collector plates, but not to said grounded collector electrodes; and means for applying a second voltage to establish second electric field lines extending from each of said second corona discharge electrodes to adjacent grounded collector electrodes, but not to said grounded collector plates.

16. The electrostatic precipitator of claim 15 wherein each of said charging section and collector section discharge electrodes is centered with respect to one of said gas flow lanes, whereby each of said charging section discharge electrodes in a gas flow lane is aligned with the collector section discharge electrodes within the gas flow lane.

17. The electrostatic precipitator of claim 15 wherein each of the charging section grounded electrodes comprise a grounded hollow pipe having a diameter between 15% and 35% of the center-to-center distance between the charging section grounded electrodes.

18. The electrostatic precipitator of claim 15 wherein said first and second electric field lines include outermost field lines which intersect but do not cross at a point defined by said mechanical joining.

* * * * *